US006422785B1

(12) United States Patent
Ruggles et al.

(10) Patent No.: US 6,422,785 B1
(45) Date of Patent: Jul. 23, 2002

(54) TRACK BELT PLACER FOR PLACING CONSTRUCTION MATERIALS AND METHOD FOR PLACING CONSTRUCTION MATERIALS

(75) Inventors: Thomas A. Ruggles, Wauwatosa, WI (US); David C. Rohrer, Albia, IA (US)

(73) Assignee: Rexcon-Division of Rose Industries, Inc., Milwaukee, WI (US)

( * ) Notice: Subject to any disclaimer, the term of this patent is extended or adjusted under 35 U.S.C. 154(b) by 0 days.

(21) Appl. No.: 09/369,521

(22) Filed: Aug. 6, 1999

(51) Int. Cl.[7] ..... E01C 19/12; B65G 41/00

(52) U.S. Cl. ..... 404/72; 404/101; 404/102; 198/317; 198/318

(58) Field of Search ..... 414/133; 198/314, 198/315, 316, 317, 318, 319, 320; 404/91, 101, 102, 105

(56) References Cited

U.S. PATENT DOCUMENTS

| | | | | |
|---|---|---|---|---|
| 314,860 A | | 3/1885 | McCoffee | |
| 620,232 A | | 2/1899 | Dingee | |
| 672,934 A | | 4/1901 | Drake | |
| 1,607,601 A | | 11/1926 | Behnke et al. | |
| 2,141,482 A | | 12/1938 | McCraw | |
| 2,488,980 A | | 11/1949 | Madeira | |
| 2,550,978 A | | 5/1951 | Dion | |
| 2,632,556 A | | 3/1953 | Alpers et al. | |
| 2,670,070 A | * | 2/1954 | Decat | 198/317 |
| 2,704,149 A | | 3/1955 | Huey | |
| 2,801,730 A | | 8/1957 | Strickler | |
| 3,130,654 A | * | 4/1964 | Apel et al. | 404/104 |
| 3,225,668 A | | 12/1965 | Maginniss | |
| 3,540,359 A | * | 11/1970 | Swisher, Jr. | 94/44 |
| 3,552,546 A | * | 1/1971 | Rath | 198/139 |
| 3,574,327 A | * | 4/1971 | Golfi | 198/8 |
| 3,636,831 A | * | 1/1972 | Davin et al. | 94/45 R |
| 3,744,615 A | * | 7/1973 | Plaquet et al. | 404/105 |
| 3,863,383 A | | 2/1975 | Spellman, Jr. | |
| 3,893,780 A | * | 7/1975 | Gutman et al. | 404/91 |
| 3,893,790 A | | 7/1975 | Gutman et al. | |
| 3,907,451 A | | 9/1975 | Fisher et al. | |
| 4,493,584 A | | 1/1985 | Guntert | |
| 4,772,156 A | | 9/1988 | Craig | |

(List continued on next page.)

FOREIGN PATENT DOCUMENTS

| | | |
|---|---|---|
| DE | 2628325 | 1/1978 |
| FR | 2332884 | 6/1977 |
| GB | 880149 | 3/1960 |

*Primary Examiner*—Thomas B. Will
*Assistant Examiner*—Raymond W Addie
(74) *Attorney, Agent, or Firm*—Ryan Kromholz & Manion, S.C.

(57) ABSTRACT

An infeed conveyor is provided with high pivot capability. High pivot capability is the capability to raise the elevation of at least one end of an infeed conveyor belt to an elevation higher than regular horizontal operation if the belt placer is operating lower than the surrounding grade. High pivot capability prevents the infeed conveyor from bottoming out on the grade of the haul road or adjacent pavement; and in some instances, high pivot capability allows use of the belt placer under conditions that belt placers without high pivot capability could not operate. Also disclosed is the ability for belt placers to be used to pave in both forward and reverse directions, whereas former belt placers could only pave in the forward direction. This is accomplished by the ability to rotate the discharge conveyor under one side of the belt placer, and changing the direction in which the belt placer travels. A belt placer and method of using a belt placer for conveying construction materials including a device for modifying the location of the strike-off from a position of first spreading location, around the belt placer to a position of second and diametrical strike-off location.

3 Claims, 8 Drawing Sheets

U.S. PATENT DOCUMENTS 4,789,266 A 12/1988 Clarke, Jr. et al.
4,822,210 A 4/1989 Oury et al.
4,861,191 A * 8/1989 Smith et al. ..... 404/104
4,924,993 A * 5/1990 Buxton ..... 193/311
4,954,010 A * 9/1990 Montgomery et al. ..... 404/96
5,120,155 A 6/1992 Samspon
5,135,333 A 8/1992 Guntert, Sr. et al.
5,435,689 A 7/1995 Stonehouse
5,452,966 A * 9/1995 Swisher, Jr. ..... 404/72
5,470,175 A 11/1995 Jensen et al.
5,492,432 A * 2/1996 Eben et al. ..... 404/115
5,590,977 A 1/1997 Guntert et al.
5,615,972 A 4/1997 Guntert et al.
5,647,688 A 7/1997 Guntert et al.

* cited by examiner

Fig. 4a
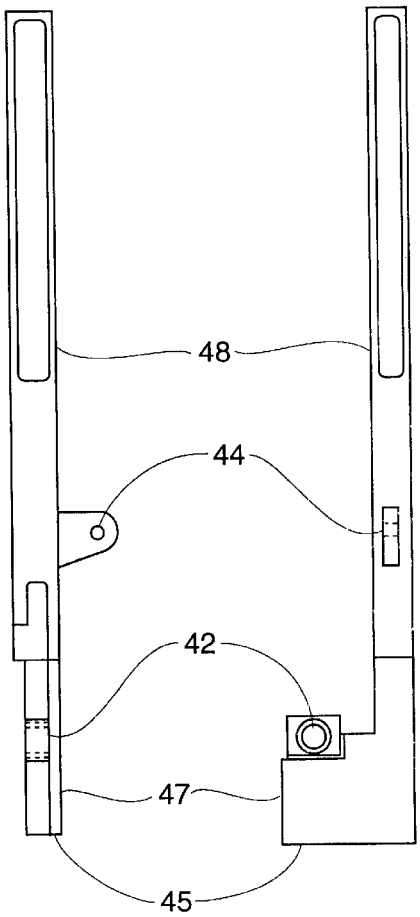
Fig. 4b
Fig. 4c
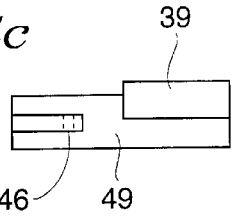
Fig. 4d
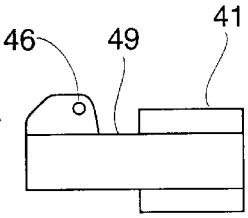
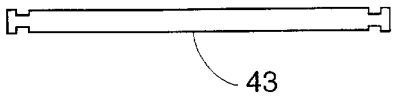
Fig. 4e

TRACK BELT PLACER FOR PLACING CONSTRUCTION MATERIALS AND METHOD FOR PLACING CONSTRUCTION MATERIALS

BACKGROUND OF THE INVENTION

1. Field of the Invention

This invention relates to track driven belt placers for conveying construction materials to a graded surface during construction.

2. Description of the Prior Art

Belt placers are commonly used as the first step in a four-step paving process. First, the road bed is cleared, prepared and graded.

Second, belt placers travel via track assemblies slowly and longitudinally along the paving direction, conveying construction materials, usually wet concrete, from a concrete supply truck to the graded road bed. The wet concrete is first loaded onto an infeed conveyor belt. This belt is capable of folding upward by use of an elbow joint, allowing trucks to drive past the belt prior to unloading the wet concrete or other construction material. This capability allows all of the trucks to travel in a straight line, creating safer and more efficient paving projects.

Next, the infeed conveyor belt conveys the wet concrete to either a second belt the discharge conveyor belt, or a spreader auger. Either the discharge conveyor belt or the spreader auger uniformly spreads the wet concrete across the graded road bed.

The third step of the paving process involves leveling, compacting, and forming the wet concrete through use of a slipform paver. Optionally, the fourth step cures and textures the wet concrete by use of a third machine. Typically these machines operate in close tandem, in order to avoid too much concrete setting during the road forming process.

After a truck pulls past the infeed conveyor belt, the truck is ready to discharge its load of concrete onto the infeed conveyor belt. Because the truck discharge is designed to quickly transfer large amounts of wet concrete to the belt placer, the transfer is not a precision operation. For example, belt placers are capable of handling approximately twenty (20) cubic yards in a minute. Invariably, the concrete splashes around the work area and eventually solidifies on the equipment. This has the undesirable consequence of hardening on some of the equipment that must maintain mobility in order to function properly. To prevent some of the concrete untidiness, fixed and manually pivoting skirting is used to protect some of the rollers underneath the belt and to facilitate lubrication of the rollers.

Traditionally, infeed conveyor belts are capable of folding upward to allow the concrete supply truck to drive a straight path on a haul road or adjacent pavement and pass the infeed conveyor belt prior to loading the belt placer. This capability works well to increase the speed of the paving process, but only if the supply truck is at the same elevation as the belt placer. If the supply truck is on a haul road or adjacent pavement that is not level with the surface that the belt placer is traveling, the infeed conveyor belt often bottoms out because the supply truck is usually higher than the graded surface. Alternatively, some belt placers are capable of raising or lowering one side of the machine in an attempt to level the machine with the haul road or adjacent pavement.

On the discharge end of the belt placer, discharge conveyor belts traditionally have the capability of rotating approximately 40°. This rotational capability allows the operator to spread the wet concrete more evenly and efficiently across the graded bed. However, this limited range of rotational capability does not work well if the belt placer has to place concrete across the entire length of an obstacle oriented perpendicular to the paving direction, such as a trench crossing. Alternatively, augers are used to spread the wet concrete in an even and efficient manner. Both of these methods prove useful for paving in one direction, and when few paving obstacles exist.

However, in order to change paving direction, the operator would have to turn the bulky and cumbersome machine around, once again decreasing efficiency. These mobilizations prove costly and time consuming, as well as presenting an element of risk to worker safety.

SUMMARY OF THE INVENTION

In order to solve the foregoing shortcomings of traditional belt placers, the invention herein relates to improved belt placers.

According to one aspect of this invention, an infeed conveyor is provided with high pivot capability. High pivot capability is the capability to raise the conveyor belt folding point, and thus the distal end of the infeed conveyor to an elevation of up to and exceeding 22" higher than regular horizontal operation if the belt placer is operating lower than the surrounding grade. High pivot capability prevents the infeed conveyor from bottoming out on the grade of the haul road or adjacent pavement; and in some instances, high pivot capability allows use of the belt placer under conditions that belt placers without high pivot capability could not operate.

An infeed conveyor for conveying construction materials from a truck is disclosed, the infeed conveyor comprising: an endless conveyor belt with a folding point, and means for raising and lowering the folding point to provide high pivot capability for the infeed conveyor.

A method of conveying construction material from a truck situated on a haul road or adjacent pavement with a grade higher than a grade that a belt placer travels on is also disclosed, the method comprising: pivoting an infeed conveyor to raise at least a portion of the bottom of the infeed conveyor to a height above the grade of the haul road or adjacent pavement; folding an infeed conveyor from a horizontal to a vertical position; allowing a truck to drive past the infeed conveyor; unfolding the infeed conveyor from the vertical to the horizontal position; and receiving construction material from the truck onto the endless conveyor belt. If the infeed conveyor has a folding point, the method can include raising the folding point of the infeed conveyor.

A high pivot assembly for raising an infeed conveyor on a belt placer is also disclosed, the high pivot assembly comprising: a high pivot leg, a lifting means, and an infeed conveyor support means. Such a high pivot assembly could include a lower lifting support, an upper lifting support, an under-conveyor support aperture, a pin, a lower lifting mechanism aperture, an immobile shaft, and an upper lifting mechanism aperture; wherein the lower lifting support is coupled to the upper lifting support, the under-conveyor support aperture creating a void through the lower lifting support, the pin coupled through the under-conveyor support aperture, the lower lifting mechanism aperture creating a void through the upper lifting support and providing a space for the lifting means to attach and lift, the immobile shaft coupled with the upper lifting support and providing the upper lifting support with a conduit for vertical movement, the upper lifting mechanism aperture creating a void through the immobile shaft and providing a space for the lifting means to attach and suspend.

According to another aspect of this invention, belt placers can now be used to pave in both forward and reverse directions, whereas former belt placers could only pave in the forward direction. This is accomplished by the ability to rotate the discharge conveyor under one side of the belt placer, and changing the direction in which the belt placer travels. According to this aspect of the invention, this belt placer now has no universal front and no true back. Both sides of the machine can act as the front of the machine: the traditional front of the machine acting as the front of the machine when the discharge conveyor is facing forward and the belt placer is operating in the forward direction, and the traditional front of the machine acting as the back of the machine when the discharge conveyor is rotated to the back side of the machine and the belt placer is operating in the reverse direction.

A belt placer for conveying construction materials is disclosed, the belt placer comprising: an infeed conveyor and a discharge conveyor, and means for rotating the discharge conveyor from a position of first discharge direction, under one side of the belt placer, to a position of second and diametrical discharge direction. A belt placer thus used could have a discharge conveyor frame pivot assembly, a hub, a pivot shaft, a pin roller, a truarc ring, a yoke roller, and an greasable shaft fitting; wherein the pin roller, the truarc ring, and the yoke roller are coupled with the hub and a discharge conveyor belt carriage assembly, the pivot shaft is threadedly coupled to the hub, and preferably a greasable shaft fitting is within the pivot shaft.

Also disclosed is a method of changing the orientation of paving direction and discharge direction of construction materials using a three-track belt placer, the method comprising: detaching a discharge conveyor belt from a swing arm; rotating the discharge conveyor belt under one hydraulic support leg; lowering the first hydraulic support leg; raising a track assembly; rotating the discharge conveyor belt under the track assembly, lowering the track assembly, raising another hydraulic support leg, rotating the discharge conveyor belt under the second hydraulic support leg, and then attaching the discharge conveyor belt to a swing arm located on the second side of the belt placer. A modified method can be used to change paving direction and discharge direction of construction materials using a four-track belt placer, by simply raising a second track assembly, and rotating the discharge conveyor belt under the second track assembly.

According to another aspect of this invention, similar to the last aspect, an auger strike-off can be repositioned from one side of the belt placer to the other side, again with the effect that the belt placer has no universal paving direction.

A belt placer for conveying construction materials is disclosed, the belt placer comprising: an infeed conveyor and an auger strike-off, and a means for modifying the location of the strike-off from a position of first spreading location, around the belt placer to a position of second and diametrical strike-off location.

DESCRIPTION OF THE DRAWINGS

FIGS. 4A, 4B, 4C, and 4D show different side views of a high pivot kit.

FIG. 4E shows a roller pin.

FIG.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
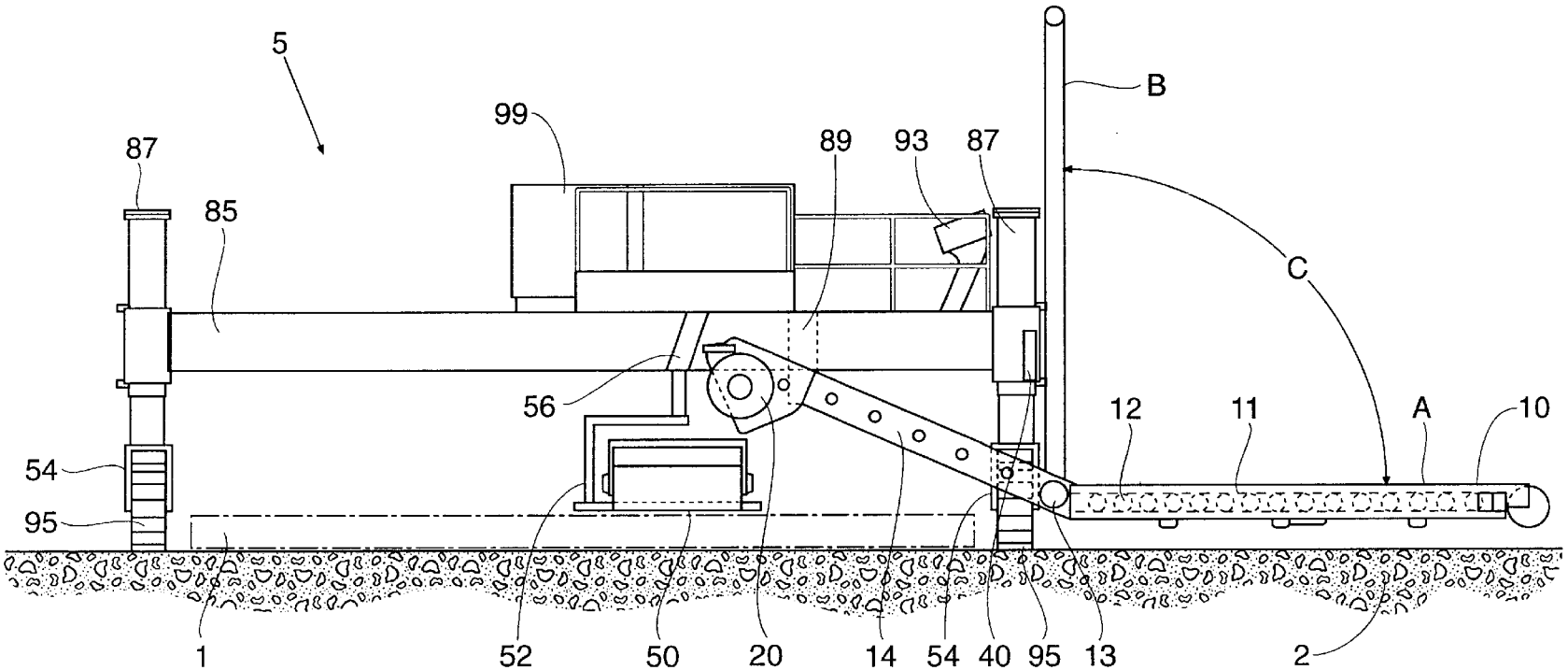
FIG. 1 is a side view of a belt placer, showing the infeed conveyor with capability to fold from A to B.
Figure 2:
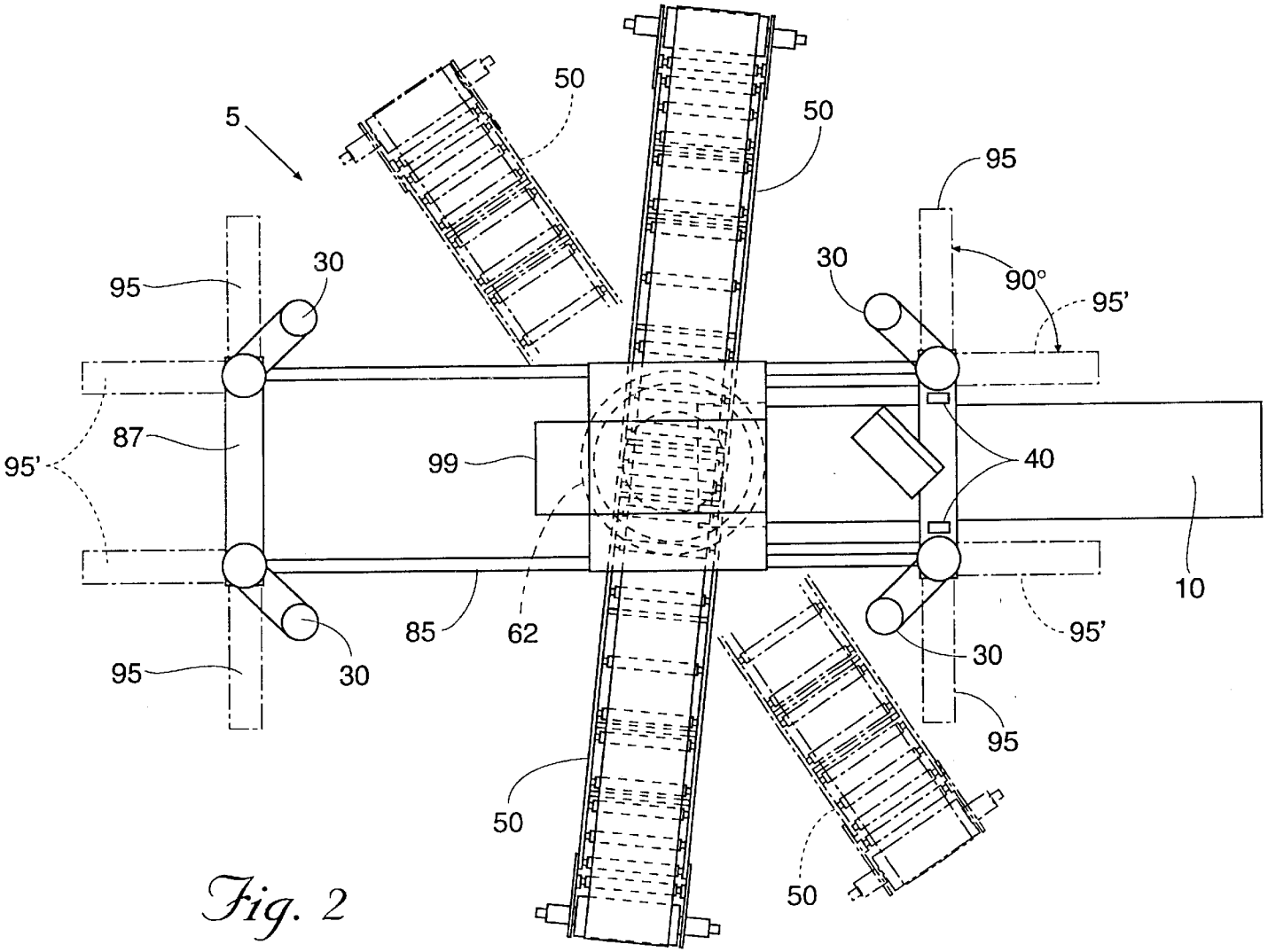
FIG. 2 is a top view of a belt placer, showing a discharge conveyor capable of rotating to both sides of a belt placer.
Figure 3A:
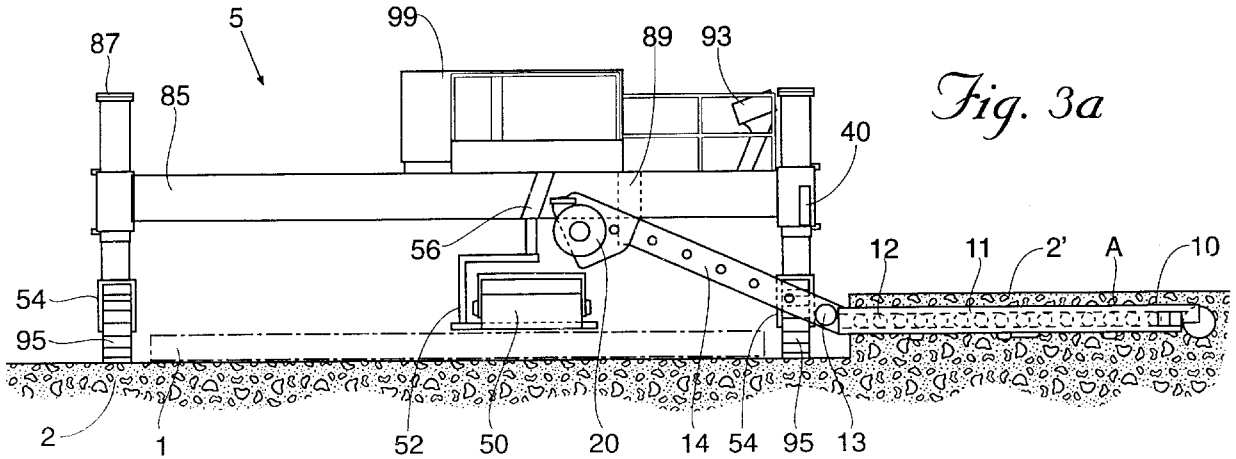
FIG. 3A is a side view of the prior art without high pivot capability.
Figure 3B:
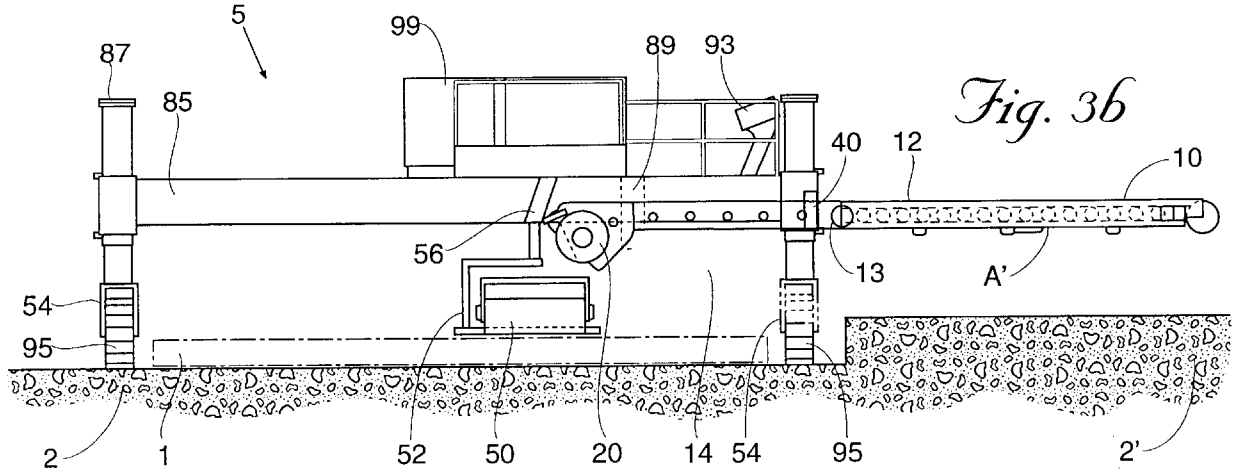
FIG. 3B is a side view of a belt placer with high pivot capability.
Figure 5:
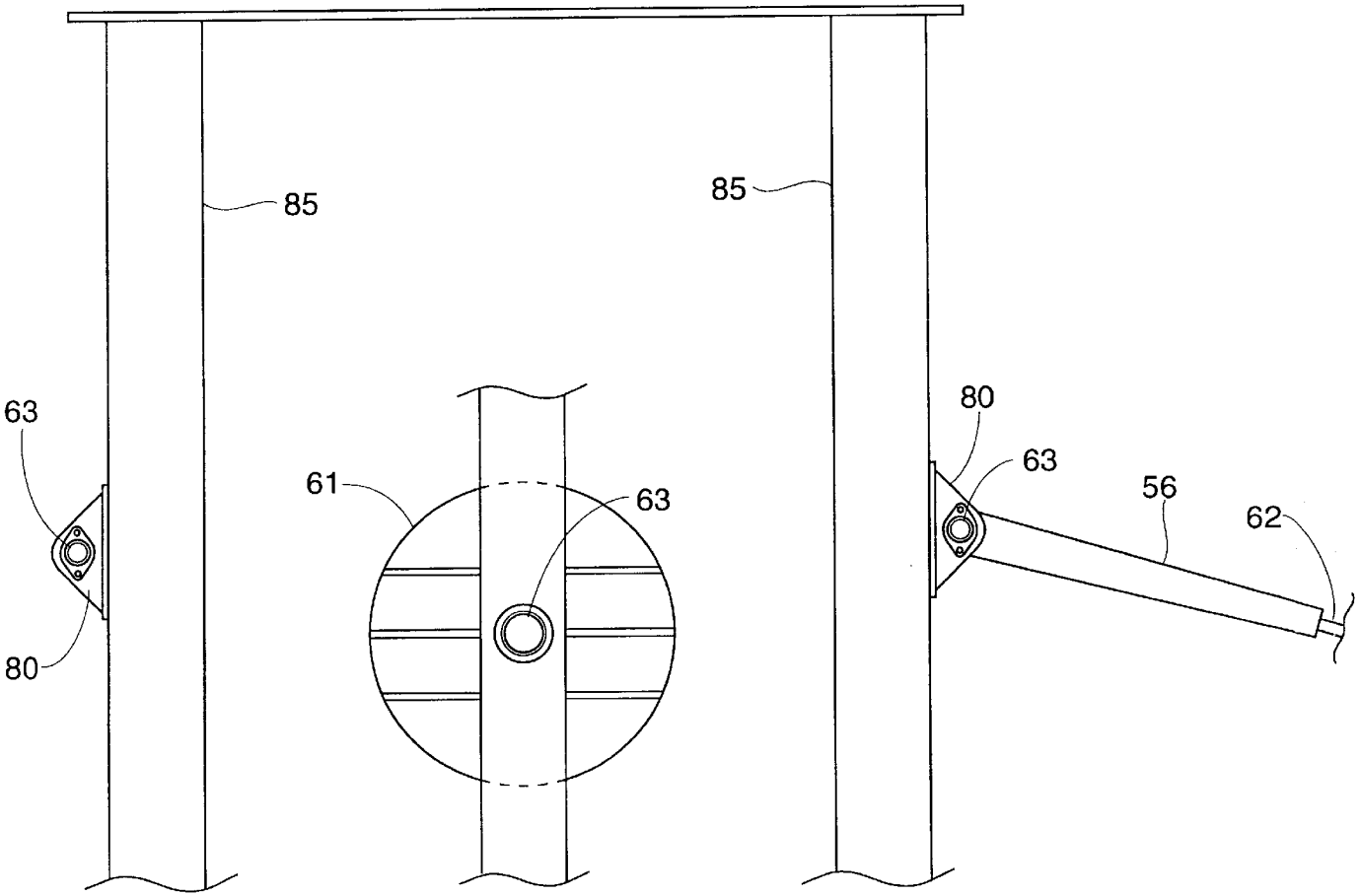
FIG. 5 shows a diagrammatic top view of a main frame, a discharge conveyor belt pivot assembly, and a swing arm. This drawing shows how the discharge conveyor belt pivot assembly and swing arm interact during rotation, and is not shown as a limitation on the rotational capabilities of the discharge conveyor.

With reference to the drawings in general, and to FIGS. 1, 2 & 3B in particular, the track belt placer is generally shown as 5.

Referring to FIG. 1, the main frame 85 can be seen connected to the end frame 87. The end frame 87 is connected to the track support structure 54, supporting the track assembly 95. The main frame 85 has a main frame recess 89 to receive torque hub 20 during high pivoting, and holds the engine and fuel tank 99, as well as the infeed conveyor control panel 93. The main frame 85 also supports the swing arm 56, which in turn supports discharge conveyor pivot assembly 52, which in turn supports the discharge conveyor 50. The high pivot torque hub 20 is also supported by the main frame 85, and the torque hub 20 supports the proximal portion 14 of the infeed conveyor 10 and supplies the endless conveyor 10 with motion. Between the proximal portion 14 of the infeed conveyor 10 and the distal portion 12 of the infeed conveyor 10 is a belt folding point 13. A high pivot assembly 40 is provided to raise and lower the belt folding point 13. The infeed conveyor 10 carries the endless conveyor belt 11.

Still referring to FIG. 1, belt placers commonly have belt folding capabilities, in order to raise the distal portion 12 from a horizontal position A to a vertical position B, allowing trucks to drive on a haul road or adjacent pavement past the infeed conveyor 10 prior to unloading the wet concrete or other construction material.

Referring now to FIGS. 1 and 2, belt placers 5 can be seen to work substantially as follows. First, the infeed conveyor 10 is folded from a horizontal position A to a vertical position B, by operator operation of infeed conveyor control panel 93; thereby allowing a truck to drive past the infeed conveyor. Next, the infeed conveyor 10 is unfolded from the vertical position B to the horizontal position A, also by operator operation of infeed conveyor control panel 93. Next, the truck unloads wet concrete or other construction material from the truck container outlet onto the endless conveyor belt 11. In one embodiment, the endless conveyor belt 11 conveys the wet concrete or other construction material to a discharge conveyor 50, which carries the wet concrete or other construction material to a construction material target area 1 (See FIG. 1).

Referring now to FIG. 2, the main frame 85 can also be seen to support the auger support arms 30. Also supported by the main frame 85 is the discharge conveyor frame pivot assembly 61. In an alternative embodiment, shown generally in FIG. 7, two auger support arms 30 can be seen to support the auger 32 (not shown in FIGS. 1–6). Conventional belt placers have only two auger support arms 30, whereas this belt placer 5 has four auger support arms 30, providing a belt placer 5 in accordance with the present invention to have the capability to remove the auger 32 and place the auger onto the other side of the belt placer 5. The high pivot assembly 40 can be seen to be located adjacent to each side of the infeed conveyor 10. Also seen in FIG. 2 is the capability to rotate each track assembly 95 from original position to the 90 degree rotated position 95'. Also shown in FIG. 2 is a discharge conveyor 50 positioned on a first side of the belt placer 5. The pivotal ability of the discharge conveyor 50 is shown in phantom, including the ability to rotate discharge conveyor 50 to the second side of the belt placer 5.

Referring to FIG. 3A, the shortcoming in the prior art is readily seen. If the grade of the haul road or adjacent pavement 2' is level with the grade 2 under the belt placer 5, infeed conveyor position A works suitably. However, referring 10 specifically to FIGS. 3A and to FIG. 3B, if the grade of the haul road or adjacent pavement 2' is elevated above the grade 2 under the belt placer 5, position A is no longer feasible. To solve this problem, the infeed conveyor 10 must be raised to position A' as shown on FIG. 3B. This is accomplished by utilizing the high pivot assembly 40 of the present invention.

Referring now to FIGS. 2 and 4A–E, the preferred embodiment of the high pivot assembly 40 includes a pair of high pivot legs 45 each having a lower lifting support 47. Lower lifting support 47 could have an under-conveyor support aperture 42, or could be pivotally attached directly to belt folding point 13 (See FIG. 1). If the high pivot leg 45 is not directly attached to the belt folding point 13, lower lifting support 47 could have an under-conveyor support aperture 42. Lower lifting support 47 is coupled with upper lifting support 48 having a lower lifting mechanism aperture 44. Upper lifting support 48 is coupled with immobile shaft 41, whereby immobile shaft 41 permits upper lifting support 48 to move linearly in both vertical directions. Also coupled with immobile shaft 41, but between immobile shaft 41 and upper lifting support 48 is upper lifting cylinder 49 having upper lifting mechanism aperture 46. Alternatively and preferably, affixed to immobile shaft 41 is a plate containing upper lifting mechanism aperture 46, thus integrating immobile shaft 41 and the upper lifting mechanism aperture 46.

Figures 6A, 6B, 6C, 6D, 6E:
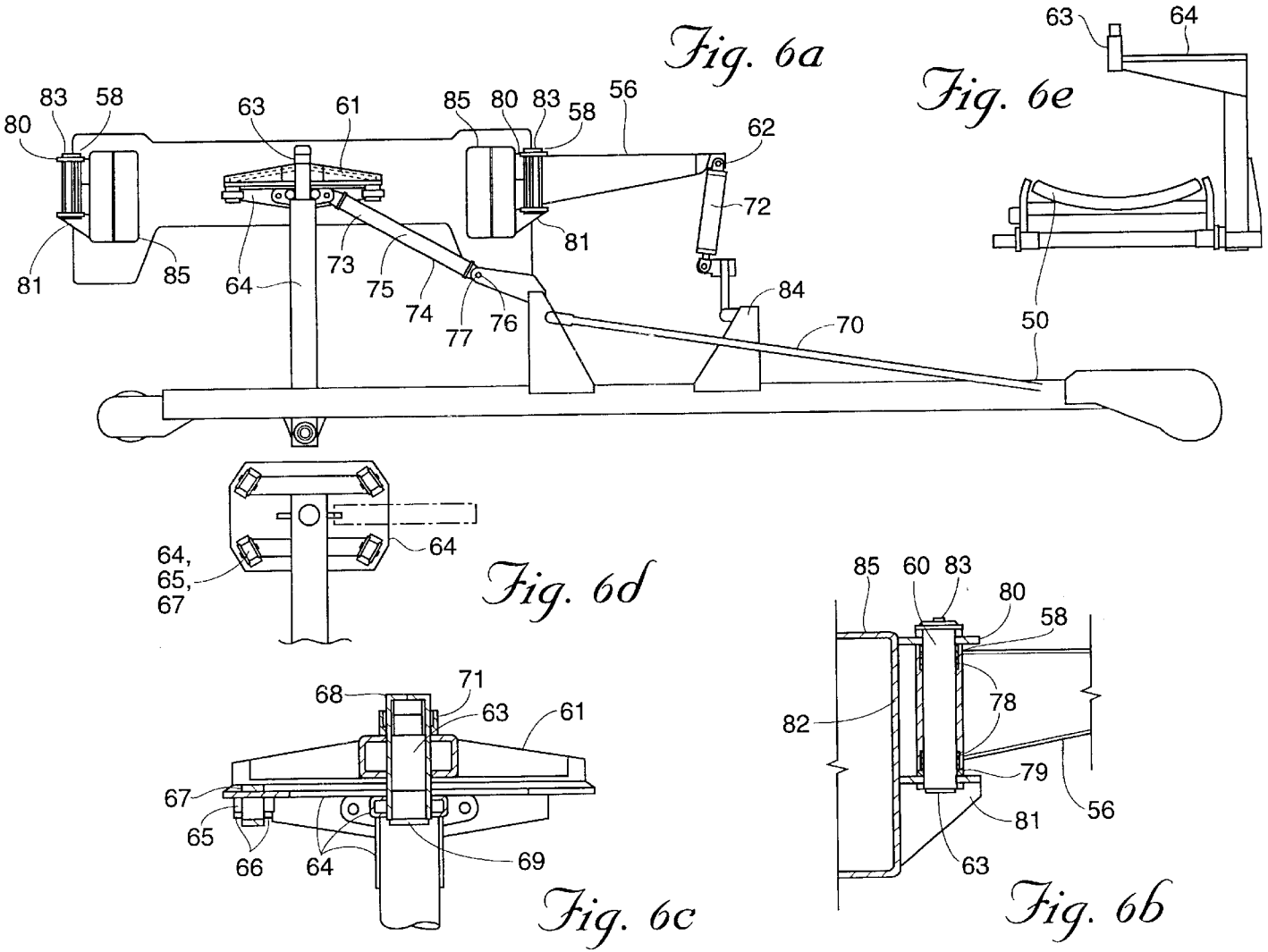
FIG. 6A is a side view of a discharge conveyor frame pivot assembly, swing arm, and discharge conveyor.
FIG. 6B is a cross-sectional view of a swing arm mounted on a main frame of a belt placer.
FIG. 6C is a cross section of a discharge conveyor frame pivot assembly.
FIG. 6D is a bottom view of a portion of a discharge conveyor belt carriage assembly.
FIG. 6E shows the discharge conveyor pivot assembly as viewed from the direction of construction material discharge.

Lifting mechanisms are well known in the art and could vary widely, including but not limited to for example a hydraulic lift, an electric or diesel or gas powered lift, a screw jack or a manually powered lift, or a winch cylinder and cables, although the preferred lifting mechanism is a hydraulic lift, the same type of hydraulic lift as shown in FIG. 6A as the lifting mechanism 72.

In the preferred embodiment, however, two pivot legs 45 are provided, along with under-conveyor support aperture 42. Between the two opposing pivot legs 45, a pin 43 is provided, capable of bearing the weight of a loaded infeed conveyor. In place of a pin, bolts or other rods could be used. Also in the preferred embodiment, the hydraulic lift unit is suspended from upper lifting mechanism 46, and the hydraulic lift unit is attached to the lower lifting mechanism aperture 44. A plate 39 is provided for attaching the high pivot legs 45 to the end frame 87, although the high pivot legs 45 could be attached to the end frame 87 through a variety of means including both mechanical fixtures and adhesives or welded bonds.

Referring now to FIGS. 1, 5, 6A and 6B, a swing arm 56 is provided for the discharge conveyor pivot assembly 52. A discharge conveyor frame pivot assembly 61 is coupled to the main frame 85, and rotates the discharge conveyor. The swing arm 56 rotates in conjunction with the discharge conveyor frame pivot assembly 61, as shown diagrammatically in FIG. 5. As the discharge conveyor frame pivot assembly 61 rotates, the swing arm 56 also rotates. Also included is discharge conveyor lift aperture 62, used to connect the swing arm 56 to a lifting mechanism 72. The lifting mechanism 72 is coupled with a yoke—rod end 84, and the yoke—rod end 84 is coupled with the discharge conveyor 50. The lifting mechanism 72 can be used to elevate the discharge end of the discharge conveyor 50.

Again, lifting mechanisms are well known in the art and could vary widely, including but not limited to for example a hydraulic lift, an electric or diesel or gas powered lift, a screw jack or a manually powered lift, or a winch cylinder and cables, although the preferred lifting mechanism is a hydraulic lift.

As best shown in FIG. 6A, the discharge conveyor frame pivot assembly 61 has the capability to rotate the discharge conveyor 50 under the track assemblies 95 if the swing arm 56 is detached from the discharge conveyor 50.

Referring now to FIGS. 6A and 6B, the swing arm 56 has a swing arm shaft 58, containing swing arm connection aperture 60. Within the aperture 60 can fit a number of common connecting and rotating mechanisms to the main frame 85. Preferably, as shown, the swing arm 56 is connected to the main frame 85 by a top pivot bracket 80 and a bottom pivot bracket 81. Bushings 78 and a thrust bearing 79 are also proved within the swing arm connection aperture 60. A pivot shaft 63 is within the swing arm connection aperture 60, provided with a lub fitting 82. A capscrew 83 is provided atop the pivot shaft 63.

Referring now to FIG. 6A, a tube—outer travel 73 is coupled with the discharge conveyor frame pivot assembly 61, and the tube—outer travel 73 is coupled with the telescopic tube—inner travel 74. Also provided is a roll pin 77, capable of insertion into the pin—travel aperture 75 or the pin—operating aperture 76. During either travel or rotation of the discharge conveyor 50 under the track assemblies 95, the roll pin 77 is coupled with the pin—travel aperture 75. During belt placer 5 operation, the roll pin 77 is coupled with the pin—operating aperture 76.

Referring now to FIGS. 6A, 6B, 6C, 6D, and 6E, a conveyor pivot assembly 52 and discharge conveyor frame pivot assembly 61 are disclosed. A second pivot shaft 63, preferably threaded at the upper end, is contained within the discharge conveyor frame pivot assembly 61, coupled with hub 71. The discharge conveyor frame pivot assembly 61 and hub 71 are supported by the main frame 85. The bottom of the discharge conveyor frame pivot assembly 61 is preferably flat. The discharge conveyor belt carriage assembly 64 supplies the discharge conveyor belt 50 with motion as known in the conveyor belt art, but preferably planetary driven by torque hubs coupled to motors. A pin roller 65, truarc ring 66 and yoke roller 67 are provided on the discharge conveyor frame pivot assembly 61 to facilitate rotational movement.

A loaded discharge conveyor 50 produces a very high moment arm, necessitating stress distribution. Preferably, as shown in FIG. 6D, four sets of pin rollers 65, truarc rings 66 and yoke rollers 67 are provided to distribute the large amount of stress produced by a loaded discharge conveyor 50. Any suitable method for supplying rotation to the hub can be used, but planetary driven torque hubs or plain motors are examples.

Preferably, a cover 68 is provided for the pivot shaft 63, preferably coated with #2 PERMATEX or other resilient coating for heat and oil resistance and lubricity. Preferably, at the lower end of the pivot shaft 63 is a greasable shaft fitting 69 or other fitting for lubrication. Connected to the discharge conveyor frame pivot assembly 61 is a discharge conveyor pivot support assembly 70. Discharge conveyor pivot support assembly 70 supports the discharge conveyor belt 50 when the lifting mechanism 72 connected to discharge conveyor lift aperture 62 is engaged to raise the discharge end of the discharge conveyor belt 50.

Figure 8:
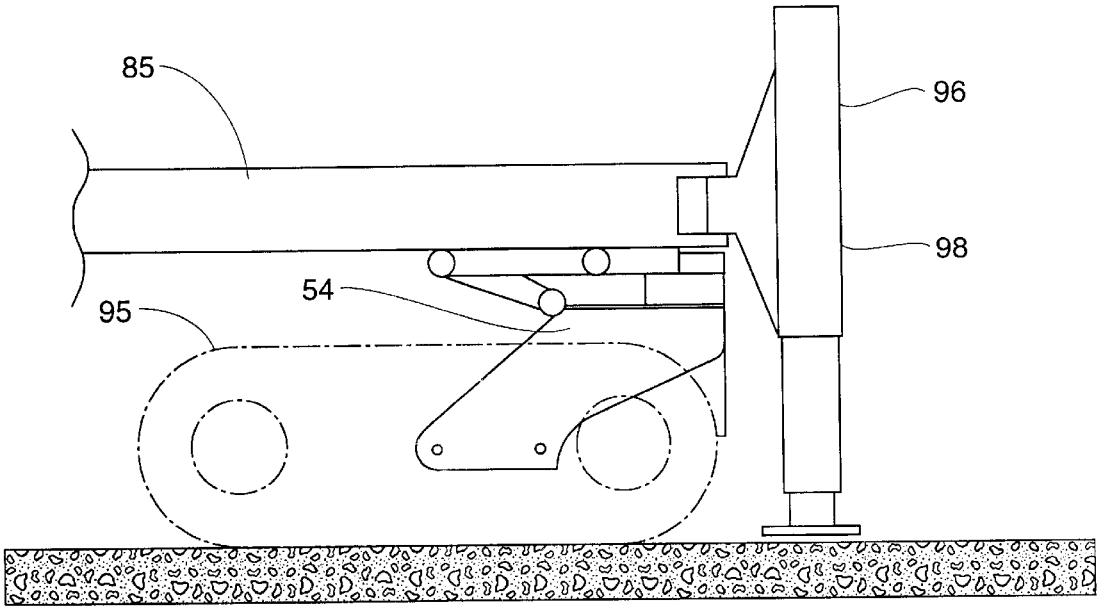
FIG. 8 shows a perspective view of one hydraulic support leg, common in the belt placer art.

Fitted with a discharge conveyor frame pivot assembly 61 and associated components, the discharge conveyor belt 50 can be rotated under any of the track assemblies 95. First, the discharge conveyor belt 50 is detached from the swing arm 56, for example by disconnecting the lifting mechanism 72 from the discharge conveyor lift aperture 62, or by disconnecting the lifting mechanism 72 from the yoke—rod end 84. Next, two hydraulic support legs 96 (one shown on FIG. 8), common in the belt placer 5 art and usually situated immediately adjacent to the track assembly 95 on the end frame 87, are lowered by a reciprocal moving mechanism 98, which could vary widely, including but not limited to for example a hydraulic lift, an electric or diesel or gas powered lift, a screw jack or a manually powered lift, or a winch cylinder and cables, although the preferred lifting mechanism is a hydraulic lift.

The hydraulic support legs 96 commonly have rotational capability, are supplied at four corners of the belt placer 5, and can be operated independently to raise and lower either one corner or one side of the belt placer 5. Next, a first track assembly 95 is raised and the discharge conveyor belt 50 is rotated under the first track assembly 95 by operation of the discharge conveyor frame pivot assembly 61, powered by conventional means and controlled by the control panel 93. Next the first track assembly 95 is lowered. Next, the first hydraulic support leg 96 is raised, and the discharge conveyor belt 50 is rotated under the first hydraulic support leg 96, and the first hydraulic support leg 96 is lowered. If the belt placer 5 is a three-track belt placer 5, next, the second hydraulic support leg 96 is raised, and the discharge conveyor belt 50 is rotated under the second hydraulic support leg 96. If the belt placer 5 is a four-track belt placer 5, next another track assembly 95 is raised and the discharge conveyor belt 50 is rotated under the track assembly 95, and the track assembly is then lowered; and then the second hydraulic support leg 96 is raised, and the discharge conveyor belt 50 is rotated under the second hydraulic support leg 96. Last, the discharge conveyor lift aperture 62 is attached to either a second swing arm 56 located on the second side of the belt placer 5, or the first swing arm 56 manually attached to the second side of the belt placer 5. Now, the belt placer 5 is prepared to operated in a direction opposite to the first direction that the machine was operating in. This capability allows the belt placer 5 to operate either right or left, as opposed to other belt placers that are limited to one-directional paving.

Figure 7A:
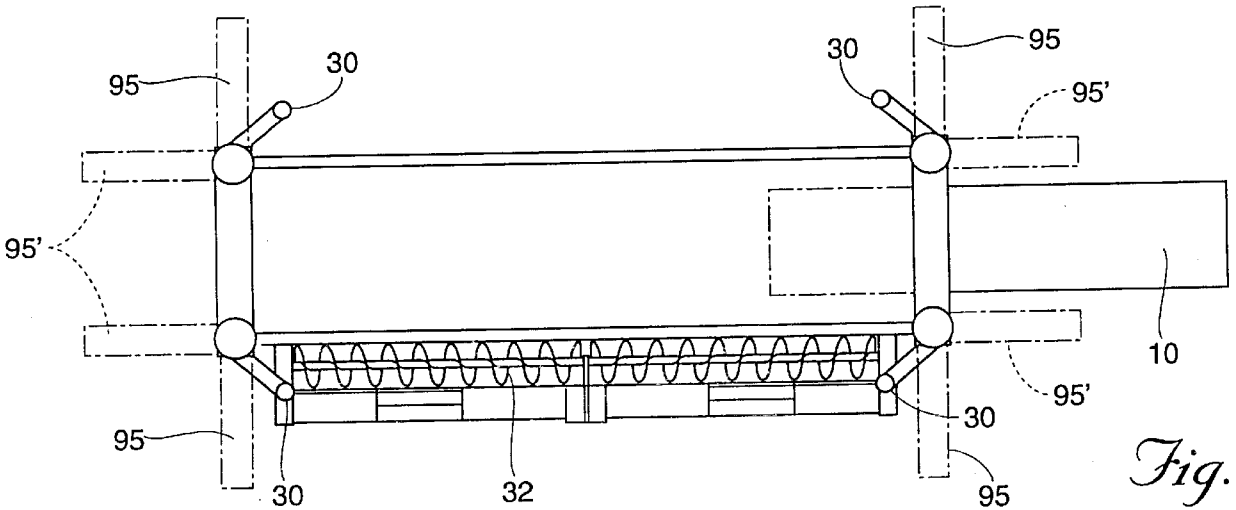
FIGS. 7*a*, 7*b* show a top view of a belt placer with greater than 180° rotational capabilities for the auger strike-off assembly.
Figure 7B:
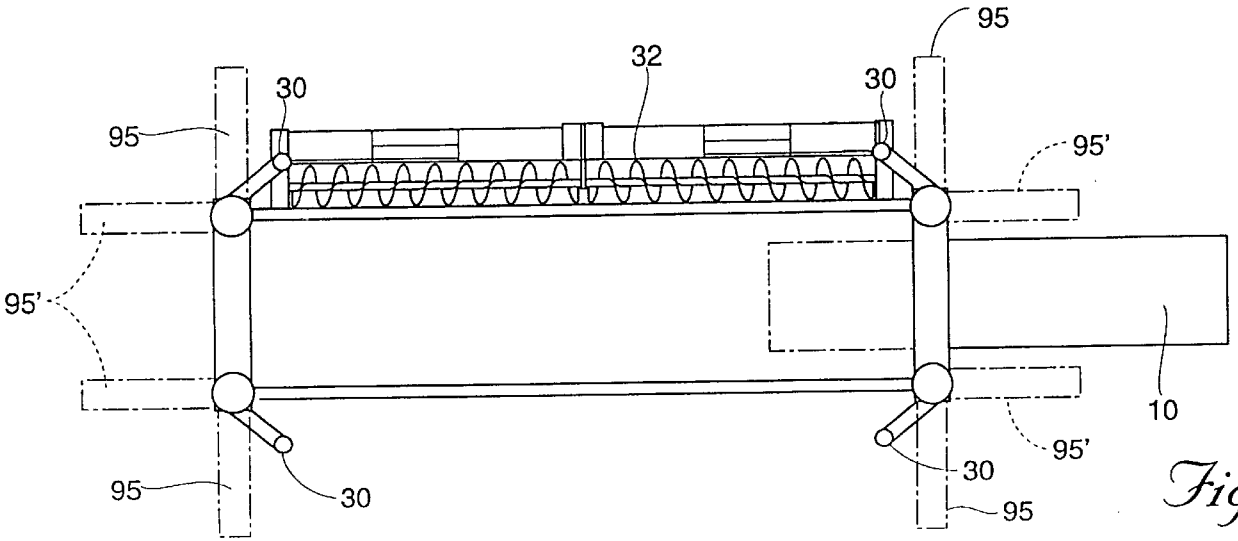

Referring now to FIGS. 7A and 7B, if the belt placer 5 is chosen to operate in conjunction with an auger-strike off 32, also commonly called an auger spreader, four auger support arms 30 are provided to support auger structure 32. Auger structure 32 can be supported by a variety of methods; for example quick connect fittings, standard nuts and bolts, or fasteners. Preferably, the auger structure 32 is a crownable, split auger at all widths. As can be seen from FIGS. 7A and 7B, the auger structure 32 can be easily detached from two auger support arms 30, and then easily reattached to the other two auger support arms 30. In this embodiment, the belt placer 5 can travel right and left, instead of just forward, as in conventional belt placers. Also seen in FIGS. 7A and 7B is the capability to rotate the track assembly 95 from original position to the 90 degree rotated position 95'.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A method of changing the orientation of a paving direction and discharge direction of construction materials on a track belt placer with a first side and a second side, the method comprising the steps of:

providing a track belt placer with a first side and a second side;

providing a frame for said belt placer, said frame including a plurality of depending, vertically movable, support legs;

providing an infeed conveyor supported by said frame;

providing a discharge conveyor rotatably supported by said frame;

providing rotating means for rotating the discharge conveyor while lying within a predetermined plane from a first discharge direction at said first side to a second discharge direction at said second side;

providing a plurality of track assemblies for support of said belt placer, each track assembly being supported by a preselected one of said plurality of said support legs and being movable therewith from an initial support position traversing said predetermined plane of rotation to a raised position above said predetermined plane of rotation of said discharge conveyor;

providing means for alternatively, and individually, raising and lowering said support legs and their respective track assemblies from and to said initial support position and from and to said raised position above said plane of rotation of said discharge conveyor;

raising one of said track assemblies from said initial support position to said raised position above the plane of rotation of said discharge conveyor;

rotating the discharge conveyor in its plane of rotation under said raised track assembly to a first rotative position;

lowering said one of said track assemblies to its initial support position;

raising a second track assembly from its initial support position to its raised position above the plane of rotation of said discharge conveyor; and rotating the discharge conveyor under the second track assembly to a second rotative position.

2. A method according to claim 1, the method further comprising the step of:providing providing a first swing arm on the first side of the belt placer;

attaching said discharge conveyor to said first swing arm;

providing a second swing arm on the second side of the belt placer;

detaching said discharge conveyor from said first swing arm; and attaching the discharge conveyor to said second swing arm.

3. A method according to claim 1, the method further comprising:

mounting an auger strike-off mechanism on said first side of side track belt placer;

removing said auger strike-off mechanism from said first side;

transporting said auger strike-off mechanism to said second side; and attaching said auger strike-off mechanism to said second side.

* * * * *